US005195735A

United States Patent [19]

Sellers

[11] Patent Number: 5,195,735

[45] Date of Patent: Mar. 23, 1993

[54] PAPER HANDLING METHOD FOR CONTROLLABLY REMOVING AN INDIVIDUAL SHEET OF PAPER FROM A STACK OF PAPER

[75] Inventor: Charles A. Sellers, Houston, Tex.

[73] Assignee: Compaq Computer Corporation, Houston, Tex.

[21] Appl. No.: 556,568

[22] Filed: Jul. 20, 1990

[51] Int. Cl.[5] ..... B65H 3/54

[52] U.S. Cl. ..... 271/21; 271/104

[58] Field of Search ..... 271/21, 22, 104

[56] References Cited

U.S. PATENT DOCUMENTS 902,751 11/1908 Maegly ..... 271/21

2,165,232 7/1939 Curtis ..... 271/22

3,866,901 2/1975 Brock ..... 271/21

FOREIGN PATENT DOCUMENTS 247237 10/1988 Japan ..... 271/21

*Primary Examiner*—Richard A. Schacher

*Attorney, Agent, or Firm*—Konneker & Bush

[57] ABSTRACT

An apparatus 10 is employed for controllably separating a top sheet of paper 52 from a stack of paper 50 and delivering this top sheet of paper 52 to a printer. A rubber wheel 26 is maneuvered into contact with the top sheet of paper 52 and is rotated in a first direction to urge the top sheet of paper 52 toward a rear surface of a tray 12 in which the stack of paper is positioned. The top sheet of paper 52 contacts the rear surface and bows upward, away from a remaining portion of the stack of paper 50. This bowing action serves to separate the top sheet of paper 52 from the sheets of paper immediately below it. Thus, once the top sheet of paper 52 is separated, the diretion of rotation of the rubber wheel 26 is reversed so as to remove the top sheet of paper 52 and deliver it to the printer.

7 Claims, 3 Drawing Sheets

PAPER HANDLING METHOD FOR CONTROLLABLY REMOVING AN INDIVIDUAL SHEET OF PAPER FROM A STACK OF PAPER

BACKGROUND OF THE INVENTION

1. Field of the Invention

This invention relates generally to a paper handling mechanism of a printer and, more particularly, to an apparatus for accurately and consistently separating and removing a single sheet of paper from a stack of paper and delivering the single sheet of paper to an electrophotographic printer.

2. Description of the Related Art

In the field of printers and photocopiers it is generally desireable that the printer/photocopier have available to it a large supply of standard, blank paper and a mechanism for removing individual sheets of paper from this relatively large supply of paper. Clearly, for the printer/photocopier to work properly, the paper handling mechanism must accurately and quickly remove individual sheets. Numerous devices have been suggested to ensure that only a single sheet of paper is removed from the supply of paper.

For example, Hewlett Packard manufacturers a desktop laser printer under the name Laser Jet®. That printer includes at least one removable tray, which houses a relatively large supply of individual sheets of paper. When the tray is loaded into the printer, a spring loaded arm enters through an opening in the bottom of the tray and raises the entire stack of paper against the paper handling mechanism. The paper handling mechanism includes a rubberized wheel in contact with the top sheet of paper in the stack of paper. This rubberized wheel is rotated in a direction designed to urge the paper toward the printer and away from the tray. It should be apparent that without some mechanism to retain the lower sheets of paper, it is likely that the rotating wheel would at least occasionally transport more than one sheet of paper into the printer at one time.

Therefore, a corner buckler is employed to retain all but the top sheet of the stack of paper. The corner buckler is a metal or plastic tab that extends over one of the leading corners of the stack of paper. Thus, when the wheel of the paper handling mechanism rotates, the paper is urged toward the printer and beneath the paper buckler. When the force exerted by the rubberized wheel is sufficiently high, the top sheet of paper buckles adjacent the corner buckler and the paper is pulled from the tray while the leading corner of the single sheet of paper contorts around the corner buckler. Once the leading corner of the paper has cleared the corner buckler, the paper returns to a generally flat configuration.

The buckling action of the paper is intended to separate the top sheet of paper from the remainder of the stack of paper. However, the complex contortions forced upon the sheet of paper necessarily limit the speed with which paper can be removed from the tray.

The present invention is directed to overcoming one or more of the problems set forth above.

SUMMARY OF THE INVENTION

In one aspect of the present invention, a method is provided for controllably removing a top sheet of paper from a stack of paper within a tray and delivering the top sheet of paper to a printer. The method comprises the steps of: moving a rubber wheel into contact with an upper surface of the top sheet of paper; rotating the rubber wheel in a first direction to urge the top sheet of paper in a first direction toward a rear surface of the tray, whereby the top sheet of paper contacts the rear surface and bows upward, away from a remaining portion of the stack of paper; and rotating the rubber wheel in a second direction to urge the top sheet of paper in a second direction away from the rear surface of the tray and into the printer.

BRIEF DESCRIPTION OF THE DRAWINGS

Other objects and advantages of the invention will become apparent upon reading the following detailed description and upon reference to the drawings in which.

Figure 1:
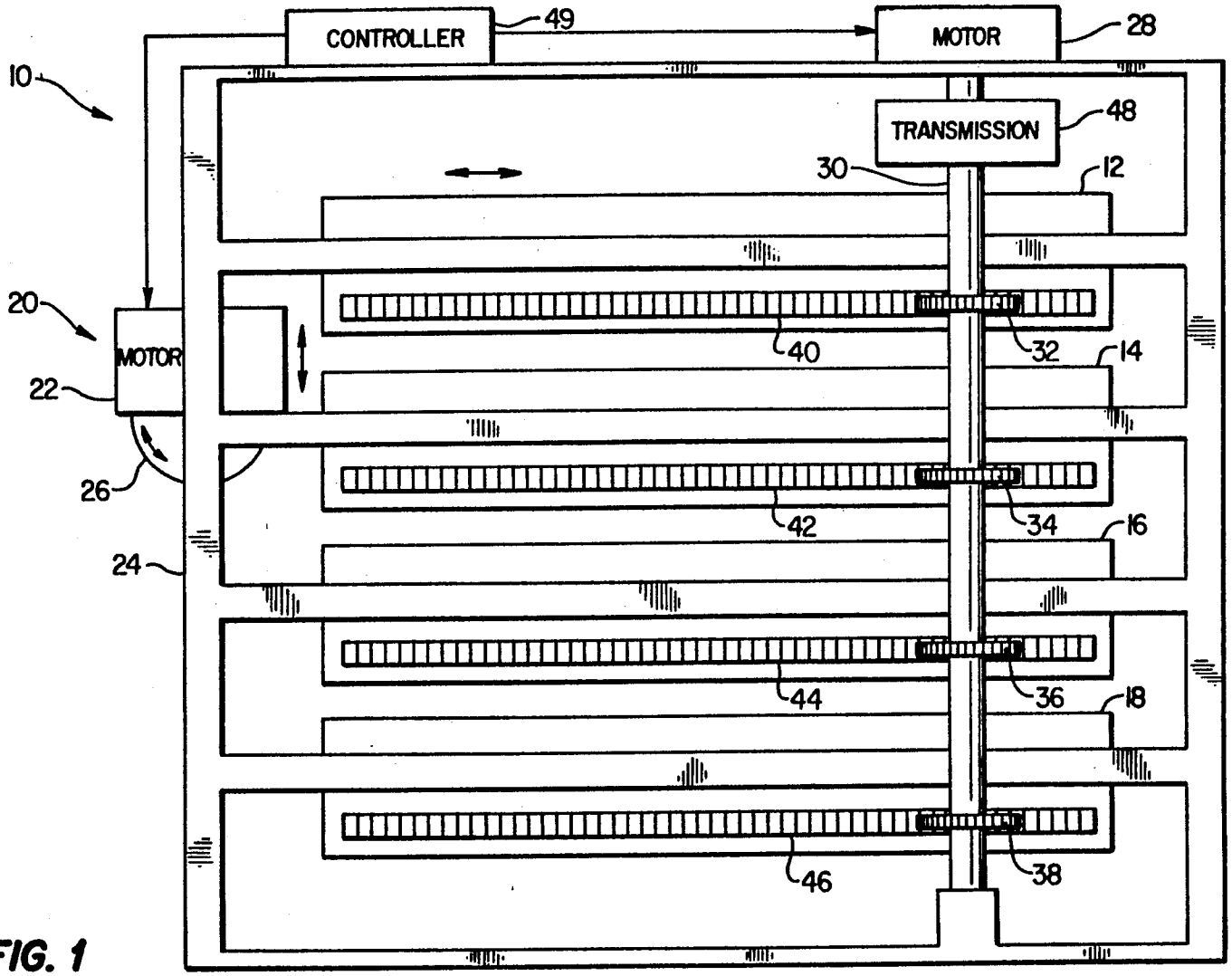
FIG. 1 illustrates a conceptual schematic of the paper handling apparatus relative to a plurality of paper receiving trays.

While the invention is susceptible to various modifications and alternative forms, specific embodiments thereof have been shown by way of example in the drawings and will herein be described in detail. It should be understood, however, that the specification is not intended to limit the invention to the particular forms disclosed therein, but on the contrary, the intention is to cover all modifications, equivalents, and alternatives falling within the spirit and scope of the invention as defined by the appended claims

DESCRIPTION OF A PREFERRED EMBODIMENT

Turning to the drawings and referring first to FIG. 1, a side view of a conceptual schematic of a paper handling apparatus 10 for a printer (not shown) is shown. While the discussion of the apparatus 10 herein is confined to being combined with an electrophotographic printer, it is readily envisioned that the apparatus 10 may be combined with various types and styles of printers and photocopiers without departing from the spirit and scope of the instant invention.

The apparatus 10 includes a series of paper containing trays 12, 14, 16, 18, which are configured to receive a variety of different styles and sizes of sheets of paper. Preferably, each tray 12, 14, 16, 8 contains a different style of paper so that a user of the electrophotographic printer simply designates which tray to use in order to select the proper style of paper. For example, it is desirable to load each of the trays 12, 14, 16, 18 respectively with letterhead, white bond, yellow bond, A4, legal, etc. Thus, the user is relieved of the time consuming task of loading the printer with additional paper each time a different style of paper is desired.

To conserve space and reduce the overall cost of the paper handling apparatus 10, the trays 12, 14, 16, 18 are arranged vertically in close proximity to one another with a single paper feeding mechanism 20 provided to operate with all of the trays 12, 14, 16, 18. The paper feeding mechanism 20 moves vertically to selectively engage one of the plurality of trays 12, 14, 16, 18. This vertical movement is effected by, for example, an electric motor 22 that is connected to and travels with the paper feeding mechanism 20 along a vertical frame assembly 24. The vertical frame assembly 24 is constructed from a variety of devices, including a rack and pinion and a rolamite; however, the details of the actual device are not critical to the instant invention. Rather, it is sufficient to understand that the vertical frame assembly 24 is of a construction to allow for engaging the top sheet in a selected tray of paper and urging the top sheet of paper in both a direction toward and away from the printer.

The motor 22 also provides power to a rotating rubber wheel 26 that contacts the stacks of paper located in each of the trays. Contact between the rotating wheel 26 and the top sheet in any of the stacks of paper urges the top sheet from the stack into the electrophotographic printer, where the actual printing process is performed.

The paper feeding mechanism 20 is generally limited to vertical movement. The trays 12, 14, 16, 18 are also vertically arranged. Therefore, for the paper feeding mechanism 20 to contact a selected one of the stacks of paper, the trays 12 14, 16, 18 are preferably horizontally moveable between a first unselected position and a second selected position where the tray intersects the vertical path of the paper feeding mechanism 20.

A single electric motor 28 provides the mechanical power to selectively drive the trays 12, 14, 16, 18 between these first and second positions. The motor 28 is connected to a shaft 30, which extends vertically along one side of the trays 12, 14, 16, 18. A plurality of gears 32, 34, 36, 38 are fixed to the shaft 30 at various vertical locations to respectively coincide with racks 40, 42, 44, 46 extending horizontally along the side of each of the trays 12, 14, 16, 18.

Thus, rotation of the motor 28 in a first direction produces similar rotation in the shaft 30 and the gears 32, 34, 36, 38. The gears 32, 34, 36, 38 interact with their corresponding rack 40, 42, 44, 46 and convert the rotational movement into horizontal linear movement of each of the trays 12, 14, 16, 18. It should be clear that rotation of the motor 28 in a first direction produces horizontal movement of the trays 12, 14, 16, 18 from the first to the second position, while rotation of the motor 28 in a second direction moves the trays 12, 14, 16, 18 from the second to the first position.

However, it should be appreciated that for the paper feeding mechanism 20 to properly intersect with the trays 12, 14, 16, 18, the selected tray is preferably horizontally moved between the unselected and selected position without corresponding movement of the unselected trays. For example, if the user desires to print on paper contained in the lowest tray 18, then not only must it move to the selected position, but the unselected trays must also remain in the unselected position. Otherwise, the trays 12, 14, 16 interfere with vertical movement of the paper feeding mechanism 20 and prevent the paper feeding mechanism 20 from descending to and contacting the paper contained in the lowest tray 18. It should be appreciated that similar problems arise when operation of intermediate trays 12, 14 is desired.

Accordingly, the motor 28 and shaft 30 employ a transmission 48 to selectively engage only one of the desired gears 32, 34, 36, 38. One embodiment of such a transmission 48 is discussed in a copending patent application by Mark H. Ruch et al, filed Jun. 2, 1989 as application No. 07/360,437.

Control of the motors 22, 28 is effected by a controller 49, such as an appropriately programmed microprocessor (not shown).

Figure 2:
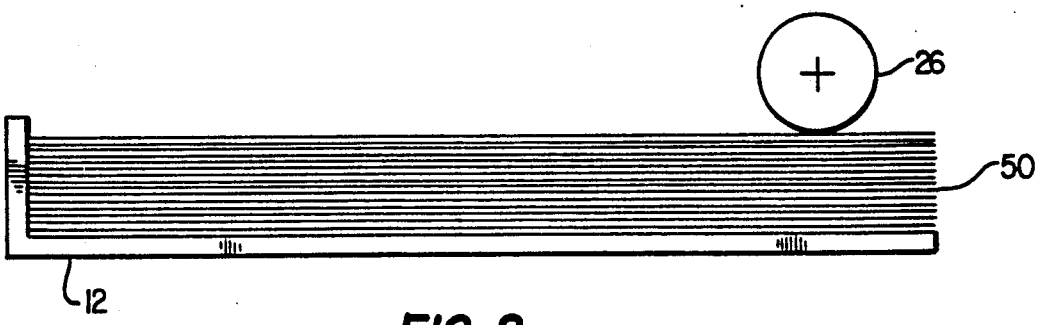
FIGS. 2–4 illustrate a side view of a sequence of steps performed by a rubberized wheel to remove a top sheet of paper from a stack of paper.
Figure 3:
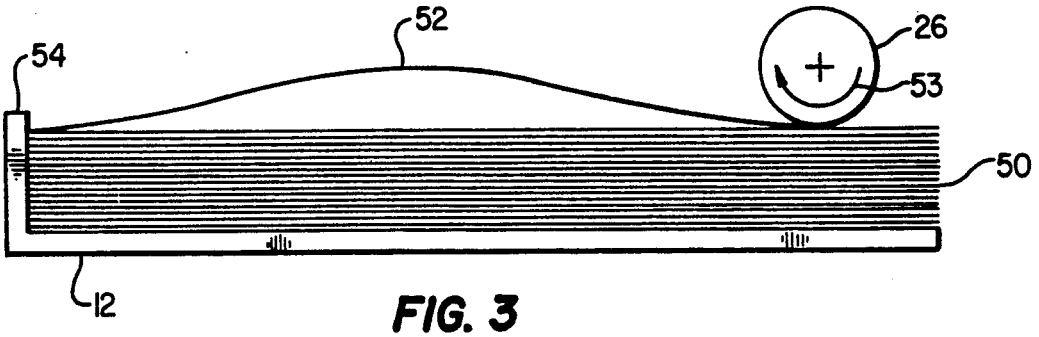
Figure 4:
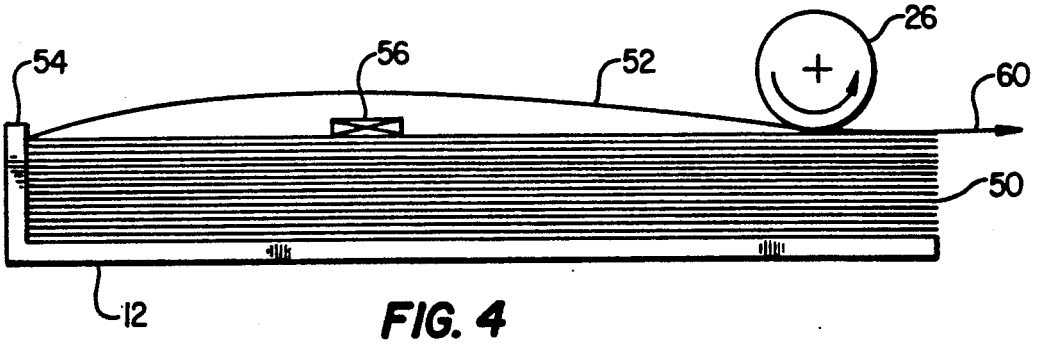

Referring now to FIGS. 2, 3, and 4, three conceptional diagrams of the interrelationship between the rubber wheel 26 and one of the trays 12, 14, 16, 18 is illustrated. In FIG. 2 one of the trays 12, 14, 16, 18 has been selected and driven to the selected position. For example, the top tray 12 is shown in the selected position with the wheel 26 engaging a stack of paper 50 within the tray 12. Once the wheel 26 comes in contact with the stack of paper 50, the following steps are performed to ensure separation of a top sheet of paper 52 from the remaining stack of paper 50. The wheel 26 is first rotated in a clockwise direction as indicated by arrow 53, which urges the top sheet of paper 52 in a direction away from the printer and toward a backstop 54 of the tray 12. The top sheet of paper 52 contacts the backstop 54 and is prevented from further horizontal movement beyond the back of the tray 12. The wheel 26 continues to rotate in the clockwise direction, forcing the top sheet of paper 52 to bow upwards and separate from the remainder of the stack of paper 50, as shown in FIG. 3.

Once the wheel 26 has been rotated to a sufficient degree to ensure that the top sheet of paper 52 has bowed away from the remaining stack of paper 50, continued rotation in the clockwise direction is ceased. At this time, the top sheet of paper 52 has been substantially separated from the remaining stack of paper 50 and there is less likelihood that removal of the sheet from the stack of paper 50 will result in any of the lower sheets of paper being removed from the stack of paper 50.

However, to ensure that none of the lower sheets of paper from the remaining stack of paper 50 are removed along with the top sheet 52, a grabber mechanism 56 is inserted between the top sheet of paper 52 and the remaining stack of paper 50, as shown in FIG. 4. Preferably, the grabber mechanism 56 is inserted from the side of the tray 12 and extends beneath the bowed section of the top sheet of paper 52. The grabber mechanism 56 has a relatively high coefficient of friction, which prevents any of the sheets of paper in the remaining stack of paper 50 from being removed along with the top sheet of paper 52.

Once the grabber mechanism 56 is fully inserted on top of the remaining stack of paper 50, the wheel 26 is rotated in a counterclockwise direction as indicated by arrow 58, thereby urging the top sheet of paper 52 in a direction indicated by arrow 60 toward the printer (not shown). Thus, it should be appreciated that the brief reverse rotation of the wheel 26 operates to separate the top sheet of paper 52 from the remaining stack of paper 50 and the grabber mechanism 56 reduces the possibility of the top sheet of paper 52 from "reattaching" to the remaining stack of paper 50 while it is being removed.

Figure 5:
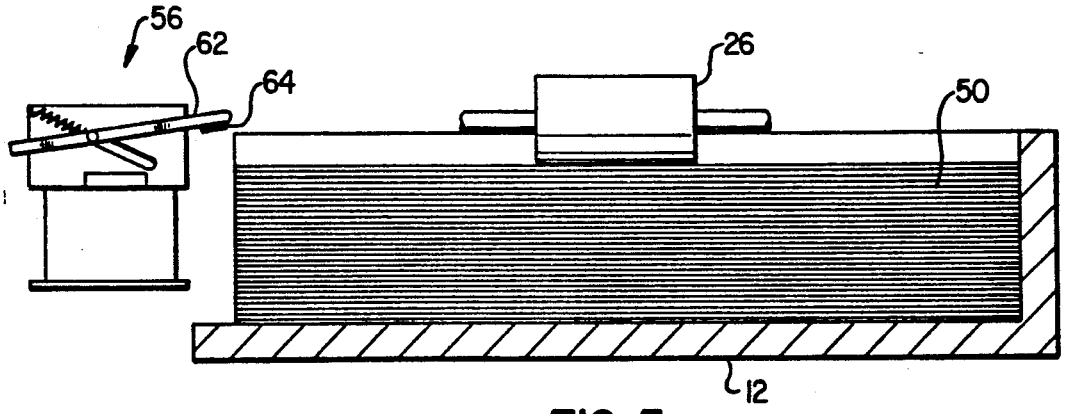
FIGS. 5–7 illustrate an end view of the sequence of steps and the interaction of a grabber mechanism.
Figure 6:
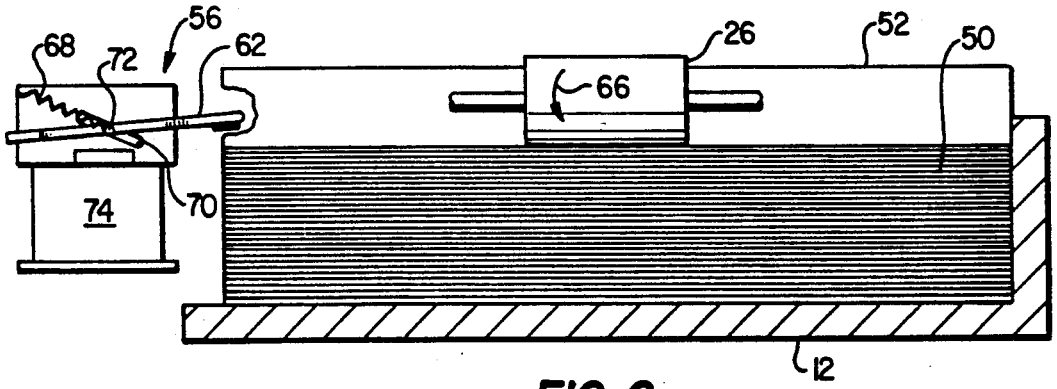
Figure 7:
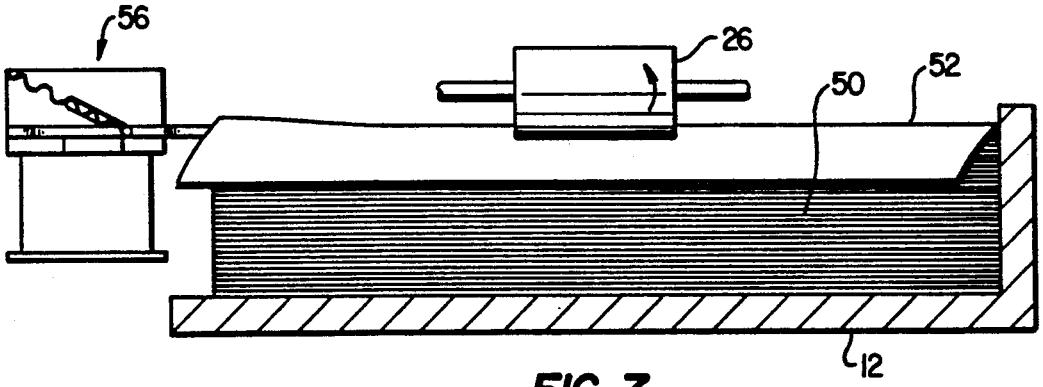

Referring now to FIGS. 5–7 a conceptual schematic of an end view of the tray 12 and its interaction with the grabber mechanism 56 is illustrated. The same sequence of events illustrated in FIGS. 2–4 are likewise illustrated in FIGS. 5–7. In FIG. 5, the rubber wheel 26 is shown engaging the top sheet of paper 52 in the tray 12 while the grabber mechanism 56 is shown positioned to the side of tray 12. The grabber mechanism 56 includes a spring loaded arm 62 with a pad of material 64 attached to its distal end. The pad of material 64 is preferably constructed from a material having a high coefficient of friction.

In FIG. 6, the rubber wheel 26 has rotated in the clockwise direction as indicated by the arrow 66 to cause the top sheet of paper 52 to bow upwards, away from the remaining stack of paper 50. The grabber mechanism 56 is illustrated in the process of extending the arm 62 beneath the bowed top sheet of paper 52. Preferably, movement of the arm 62 is produced by a coil spring 68, while motion of the arm 62 is guided by a slot 70. A pin 72 extends through the arm 62 and is retained in the slot 70. A solenoid 74 normally urges the arm 62 in the position illustrated in FIG. 5. Thus, when power is removed from the solenoid 74 by, for example, the controller illustrated in FIG. 1, the coil spring 68 expands and drives the arm 62 diagonally down the slot 70 and into firm engagement with the remaining stack of paper 50.

FIG. 7 illustrates the grabber mechanism 56 fully inserted beneath the bow in the top sheet of paper 52 and contacting the remaining stack of paper 50. Further, the rubber wheel 26 is rotated in the counterclockwise direction so as to remove the top sheet of paper 52 from the remaining stack of paper 50.

It is preferred that a single grabber mechanism 56 be associated with all the trays 12, 14, 16, 18. The grabber mechanism 56 is physically attached to the motor 20 and travels up and down the frame assembly 24 in unison with the motor 20 and rubber wheel 26. In this manner, the grabber mechanism 56 is automatically positioned adjacent the selected tray at a height corresponding to the height of paper remaining in the stack 50.

Control of the solenoid 74 within the grabber mechanism 56 is preferably effected by the controller 49. Thus, the controller 49 correlates movement of the trays 12, 14, 16, 18, the paper feeding mechanism 20, and the grabber mechanism 56 so that the entire apparatus 10 performs in a predictable and controlled manner.

I claim:

1. A method of horizontally removing a top sheet of paper from a stack of paper within a tray having a rear surface, said method comprising the steps of:

bringing a wheel member into frictional contact with the upper side surface of said top sheet of paper;

rotating said wheel member in a first direction to rearwardly drive said top sheet of paper against said rear tray surface in a manner causing a portion of said top sheet of paper to bow upwardly away from the remainder of said stack of paper;

moving a grabber member into and downwardly through the space between the upwardly bowed top sheet portion and said remainder of said stack of paper in a manner causing said grabber member to contact said remainder of said stack of paper with a downward force sufficient to essentially preclude it from being shifted by rotation of said wheel member; and rotating said wheel member in a second direction opposite said first direction to forwardly remove said top sheet of paper from said remainder of said stack of paper.

2. The method of claim 1 wherein said moving step is performed by horizontally moving said grabber member along a downwardly inclined path into said space between said upwardly bowed top sheet portion and said remainder of said stack of paper.

3. The method of claim 2 wherein said horizontally moving step includes the steps of:

supporting said grabber member on an end of an elongated arm member;

supporting a longitudinally intermediate portion of said elongated arm member for translational movement along a downwardly inclined path having an upper end, and a lower end positioned between said upper end and said stack of paper, and driving said longitudinally intermediate portion of said elongated arm member from said upper end of said path to said lower end of said path.

4. Apparatus for horizontally removing a top sheet of paper from a stack of paper within a tray having a rear surface, said apparatus comprising:

a wheel member;

means for bringing a wheel member into frictional contact with the upper side surface of said top sheet of paper;

means for rotating said wheel member in a first direction to rearwardly drive said top sheet of paper against said rear tray surface in a manner causing a portion of said top sheet of paper to bow upwardly away from the remainder of said stack of paper;

a grabber member;

means for moving said grabber member into and downwardly through the space between the upwardly bowed portion of said top sheet of paper and said remainder of said stack of paper in a manner causing said grabber to contact said remainder of said stack of paper with sufficient downward force to essentially preclude it from being horizontally shifted by rotation of said wheel member; and means for rotating said wheel member in a second direction opposite to said first direction to forwardly remove said top sheet of paper from said remainder of said stack of paper.

5. The apparatus of claim 4 wherein:

said means for moving are operative to horizontally move said grabber member along a path downwardly inclined toward the upper side surface of said remainder of said stack of paper.

6. The apparatus of claim 5 wherein said grabber member is mounted on an end of an elongated arm member, and said means for moving include:

a support structure positioned horizontally outwardly of said stack of paper and having a slot formed therein, said slot being downwardly inclined toward said stack of paper and having upper and lower ends, a pin member secured to a longitudinally intermediate portion of said elongated arm member and received in said slot for movement therein between said upper and lower ends thereof.

means for moving said pin member to a selected one of said upper and lower ends of said slot.

7. The apparatus of claim 6 wherein said means for moving said pin member to a selected one of said upper and lower ends of said slot include:

solenoid valve means operative to forcibly move said pin member to and releasably hold it against said upper end of said slot, and spring means for resiliently biasing said pin member toward said lower end of said slot.

* * * * *

UNITED STATES PATENT AND TRADEMARK OFFICE

CERTIFICATE OF CORRECTION

PATENT NO. : 5,195,735

DATED : March 23, 1993

INVENTOR(S) : Charles A. Sellers

It is certified that error appears in the above-identified patent and that said Letters Patent is hereby corrected as shown below:

Column 2, line 50, "8" should be --18--.

Signed and Sealed this

Fourteenth Day of December, 1993

*Attest:*

*Attesting Officer*

BRUCE LEHMAN

*Commissioner of Patents and Trademarks*